US008899323B2

(12) United States Patent
Zazovsky et al.

(10) Patent No.: US 8,899,323 B2
(45) Date of Patent: Dec. 2, 2014

(54) MODULAR PUMPOUTS AND FLOWLINE ARCHITECTURE

(75) Inventors: Alexander F. Zazovsky, Houston, TX (US); Mark Milkovisch, Cypress, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 341 days.

(21) Appl. No.: 13/304,971

(22) Filed: Nov. 28, 2011

(65) Prior Publication Data

US 2012/0132419 A1 May 31, 2012

Related U.S. Application Data

(60) Continuation-in-part of application No. 12/690,231, filed on Jan. 20, 2010, now Pat. No. 8,210,260, which is a continuation-in-part of application No. 11/609,384, filed on Dec. 12, 2006, now Pat. No. 8,555,968, which is a continuation-in-part of application No. 11/219,244, filed on Sep. 2, 2005, now Pat. No. 7,484,563, which is a continuation-in-part of application No. 10/711,187, filed on Aug. 31, 2004, now Pat. No. 7,178,591, which is a continuation-in-part of application No. 11/076,567, filed on Mar. 9, 2005, which is a division of application No. 10/184,833, filed on Jun. 28, 2002, application No. 13/304,971, which is a continuation-in-part of application No. 12/478,819, filed on Jun. 5, 2009.

(60) Provisional application No. 61/426,573, filed on Dec. 23, 2010.

(51) Int. Cl.

| | |
|---|---|
| ***E21B 49/08*** | (2006.01) |
| ***E21B 49/10*** | (2006.01) |
| ***E21B 49/00*** | (2006.01) |

(52) U.S. Cl.

CPC ..... *E21B 49/008* (2013.01); *E21B 49/10* (2013.01)

USPC ..... 166/264; 166/100

(58) Field of Classification Search

CPC ..... E21B 49/00; E21B 49/08; E21B 49/082

USPC ..... 166/264, 250.14, 369, 54.1, 68, 100

See application file for complete search history.

(56) References Cited

U.S. PATENT DOCUMENTS

| | | | |
|---|---|---|---|
| 3,121,459 | A | 2/1964 | Van Ness, Jr. et al. |
| 3,295,615 | A | 1/1967 | Brieger et al. |

(Continued)

FOREIGN PATENT DOCUMENTS

| | | | |
|---|---|---|---|
| GB | 2400910 | A | 10/2004 |
| GB | 2417506 | A | 3/2006 |

(Continued)

OTHER PUBLICATIONS

"Wireline Formation Testing and Sampling", Schlumberger Limited, 1996, pp. 4-1 to 4-47.

(Continued)

*Primary Examiner* — Brad Harcourt

(74) *Attorney, Agent, or Firm* — Cathy Hewitt

(57) ABSTRACT

Modular pumpouts and flowline architecture are described. An example apparatus includes a downhole tool to sample fluid from a subterranean formation, and a plurality of fluidly coupled pump modules disposed on the downhole tool. Each of the pump modules includes: a pump having a pump inlet and a pump outlet, where the pump inlet is coupled to a first flowline; a first valve assembly having first, second and third ports, wherein the first port is coupled to the first flowline, the second port is coupled to the pump outlet, and the third port is coupled to the first flowline; and a second flowline not fluidly coupled to the first valve assembly or the pump.

18 Claims, 7 Drawing Sheets

(56) References Cited

U.S. PATENT DOCUMENTS

| | | | |
|---|---|---|---|
| 3,323,361 | A | 6/1967 | Lebourg |
| 3,352,361 | A | 11/1967 | Urbanosky |
| 3,385,364 | A | 5/1968 | Whitten |
| 3,430,181 | A | 2/1969 | Urbanosky |
| 3,430,711 | A | 3/1969 | Taggart |
| 3,530,933 | A | 9/1970 | Whitten |
| 3,565,169 | A | 2/1971 | Bell |
| 3,611,799 | A | 10/1971 | Davis |
| 3,653,436 | A | 4/1972 | Anderson et al. |
| 3,677,081 | A | 7/1972 | Newton et al. |
| 3,782,191 | A | 1/1974 | Whitten |
| 3,813,936 | A | 6/1974 | Urbanosky et al. |
| 3,859,851 | A | 1/1975 | Urbanosky |
| 3,864,970 | A | 2/1975 | Bell |
| 3,924,463 | A | 12/1975 | Urbanosky |
| 3,934,468 | A | 1/1976 | Brieger |
| 3,952,588 | A | 4/1976 | Whitten |
| 4,246,782 | A | 1/1981 | Hallmark |
| 4,287,946 | A | 9/1981 | Brieger |
| 4,339,948 | A | 7/1982 | Hallmark |
| 4,369,654 | A | 1/1983 | Hallmark |
| 4,392,376 | A | 7/1983 | Lagus et al. |
| 4,402,910 | A | 9/1983 | Smith et al. |
| 4,416,152 | A | 11/1983 | Wilson |
| 4,492,862 | A | 1/1985 | Grynberg et al. |
| 4,513,612 | A | 4/1985 | Shalek |
| 4,535,843 | A | 8/1985 | Jageler |
| 4,573,532 | A | 3/1986 | Blake |
| 4,635,717 | A | 1/1987 | Jageler |
| 4,680,581 | A | 7/1987 | Kozlik et al. |
| 4,690,216 | A | 9/1987 | Pritchard |
| 4,860,580 | A | 8/1989 | Durocher |
| 4,860,581 | A | 8/1989 | Zimmerman et al. |
| 4,879,900 | A | 11/1989 | Gilbert |
| 4,931,343 | A | 6/1990 | Becker et al. |
| 4,936,139 | A | 6/1990 | Zimmerman et al. |
| 4,951,749 | A | 8/1990 | Carroll |
| 4,994,671 | A | 2/1991 | Safinya et al. |
| 5,056,959 | A | 10/1991 | Cannac et al. |
| 5,166,747 | A | 11/1992 | Schroeder et al. |
| 5,230,244 | A | 7/1993 | Gilbert |
| 5,265,015 | A | 11/1993 | Auzerais et al. |
| 5,266,800 | A | 11/1993 | Mullins |
| 5,279,153 | A | 1/1994 | Dussan V. et al. |
| 5,303,775 | A | 4/1994 | Michaels et al. |
| 5,331,156 | A | 7/1994 | Hines et al. |
| 5,335,542 | A | 8/1994 | Ramakrishnan et al. |
| 5,337,838 | A | 8/1994 | Sorensen |
| 5,377,755 | A | 1/1995 | Michaels et al. |
| 5,517,464 | A | 5/1996 | Lerner et al. |
| 5,540,280 | A | 7/1996 | Schultz et al. |
| 5,587,525 | A | 12/1996 | Shwe et al. |
| 5,622,223 | A | 4/1997 | Vasquez |
| 5,765,637 | A | 6/1998 | Dietle et al. |
| 5,770,798 | A | 6/1998 | Georgi et al. |
| 5,799,733 | A | 9/1998 | Ringgenberg et al. |
| 5,803,186 | A | 9/1998 | Berger et al. |
| 5,826,662 | A | 10/1998 | Beck et al. |
| 5,859,430 | A | 1/1999 | Mullins et al. |
| 5,923,171 | A | 7/1999 | Koelman et al. |
| 5,934,374 | A | 8/1999 | Hrametz et al. |
| 5,939,717 | A | 8/1999 | Mullins |
| 6,157,893 | A | 12/2000 | Berger et al. |
| 6,164,126 | A | 12/2000 | Ciglenec et al. |
| 6,176,323 | B1 | 1/2001 | Weirich et al. |
| 6,178,815 | B1 | 1/2001 | Felling et al. |
| 6,216,662 | B1 | 4/2001 | Sapsford |
| 6,223,822 | B1 | 5/2001 | Jones |
| 6,230,557 | B1 | 5/2001 | Ciglenec et al. |
| 6,274,865 | B1 | 8/2001 | Schroer et al. |
| 6,301,959 | B1 | 10/2001 | Hrametz et al. |
| 6,343,507 | B1 | 2/2002 | Felling et al. |
| 6,350,966 | B1 | 2/2002 | Potthof et al. |
| 6,350,986 | B1 | 2/2002 | Mullins et al. |
| 6,415,864 | B1 | 7/2002 | Ramakrishnan et al. |
| 6,435,279 | B1 | 8/2002 | Howe et al. |
| 6,437,326 | B1 | 8/2002 | Yamate et al. |
| 6,467,544 | B1 | 10/2002 | Brown et al. |
| 6,474,152 | B1 | 11/2002 | Mullins et al. |
| 6,476,384 | B1 | 11/2002 | Mullins et al. |
| 6,478,096 | B1 | 11/2002 | Jones et al. |
| 6,568,487 | B2 | 5/2003 | Meister et al. |
| 6,585,045 | B2 | 7/2003 | Lee et al. |
| 6,609,568 | B2 | 8/2003 | Krueger et al. |
| 6,622,554 | B2 | 9/2003 | Manke et al. |
| 6,627,873 | B2 | 9/2003 | Tchakarov et al. |
| 6,658,930 | B2 | 12/2003 | Abbas |
| 6,659,177 | B2 | 12/2003 | Bolze et al. |
| 6,668,924 | B2 | 12/2003 | Bolze et al. |
| 6,707,556 | B2 | 3/2004 | Turner et al. |
| 6,714,872 | B2 | 3/2004 | DiFoggio et al. |
| 6,719,049 | B2 | 4/2004 | Sherwood et al. |
| 6,722,432 | B2 | 4/2004 | Spiers et al. |
| 6,729,399 | B2 | 5/2004 | Follini et al. |
| 6,745,835 | B2 | 6/2004 | Fields |
| 6,768,105 | B2 | 7/2004 | Mullins et al. |
| 6,769,296 | B2 | 8/2004 | Montalvo et al. |
| 6,871,713 | B2 | 3/2005 | Meister et al. |
| 6,877,559 | B2 | 4/2005 | Hashem |
| 6,905,241 | B2 | 6/2005 | Zazovsky et al. |
| 6,964,301 | B2 | 11/2005 | Hill et al. |
| 7,090,012 | B2 | 8/2006 | Hill et al. |
| 7,096,976 | B2 | 8/2006 | Paluch et al. |
| 7,114,562 | B2 | 10/2006 | Fisseler et al. |
| 7,140,436 | B2 | 11/2006 | Grant et al. |
| 7,178,591 | B2 | 2/2007 | Del Campo et al. |
| 7,484,563 | B2 | 2/2009 | Zazovsky et al. |
| 7,857,049 | B2 | 12/2010 | Sherwood |
| 2001/0035312 | A1 | 11/2001 | Han et al. |
| 2002/0100585 | A1 | 8/2002 | Spiers et al. |
| 2002/0112854 | A1 | 8/2002 | Krueger et al. |
| 2002/0185313 | A1 | 12/2002 | Jones et al. |
| 2002/0189339 | A1 | 12/2002 | Montalvo et al. |
| 2003/0042021 | A1 | 3/2003 | Bolze et al. |
| 2003/0042024 | A1 | 3/2003 | Freeman et al. |
| 2003/0145652 | A1 | 8/2003 | Arian |
| 2003/0217845 | A1 | 11/2003 | Sherwood et al. |
| 2003/0234120 | A1 | 12/2003 | Paluch et al. |
| 2004/0000433 | A1 | 1/2004 | Hill et al. |
| 2004/0083805 | A1 | 5/2004 | Ramakrishnan et al. |
| 2004/0099443 | A1 | 5/2004 | Meister et al. |
| 2004/0163808 | A1 | 8/2004 | Ringgenberg et al. |
| 2004/0178336 | A1 | 9/2004 | DiFoggio |
| 2004/0231842 | A1 | 11/2004 | Shammai et al. |
| 2005/0039527 | A1 | 2/2005 | Dhruva et al. |
| 2005/0109538 | A1 | 5/2005 | Fisseler et al. |
| 2005/0171699 | A1 | 8/2005 | Zazovsky et al. |
| 2005/0182566 | A1 | 8/2005 | DiFoggio |
| 2006/0000603 | A1 | 1/2006 | Zazovsky et al. |
| 2006/0042793 | A1 | 3/2006 | Del Campo et al. |
| 2006/0076132 | A1 | 4/2006 | Nold et al. |
| 2006/0117842 | A1 | 6/2006 | Ramakrishnan |
| 2007/0209793 | A1 | 9/2007 | Nold, III et al. |
| 2008/0245569 | A1 | 10/2008 | Nold, III et al. |
| 2009/0025926 | A1 | 1/2009 | Briquet et al. |
| 2009/0044951 | A1 | 2/2009 | Milkovisch et al. |
| 2009/0321072 | A1 | 12/2009 | Kanayama et al. |

FOREIGN PATENT DOCUMENTS

| | | | |
|---|---|---|---|
| GB | 2418938 | A | 4/2006 |
| WO | 9603628 | A1 | 2/1996 |
| WO | 9530628 | A1 | 10/1996 |
| WO | 0050876 | A1 | 8/2000 |
| WO | 03098639 | A1 | 11/2003 |
| WO | 2004020982 | A1 | 3/2004 |
| WO | 2005065277 | A2 | 7/2005 |

OTHER PUBLICATIONS

Akram, et al., "A Model to Predict Wireline Formation Tester Sample Contamination", SPE 48959, SPE Annual Technical Conference and Exhibition, Sep. 27-30, 1998, pp. 27-33.

(56) References Cited

OTHER PUBLICATIONS

Crombie, et al., "Innovations in Wireline Fluid Sampling", Oilfield Review, 1998, pp. 26-41.
Dong, et al., "In-Situ Contaminaton Monitoring and GOR Measurement of Formation Fluid Samples", SPE 77899, SPE Asia Pacific Oil and Gas Conference and Exhibition, 2002, pp. 1-9.
Hammond, P.S., "One or Two Phased Flow During Fluid Sampling by a Wireline Tool", Transport in Porous Media, vol. 6(3), 1991, pp. 299-330.
Hashem, et al., "Determination of Producible Hydrocarbon Type and Oil Quality in Wells Drilled with Synthetic Oil-Based Muds", SPE Reservoir Eval. & Eng. 2, Apr. 1999, pp. 125-133.
Mullins, et al., "Optimization of Wireline Sample Quality by Real-Time Analysis of Oil-Based Mud Contamination—Examples from North Sea Opertions", SPE 71736, 2001, pp. 1-6.
Mullins, et al., "Real-Time Determination of Filtrate Contamination During Openhole Wireline Sampling by Optical Spectroscopy", SPE 63071—SPE Annual Technical Conference and Exhibition, Dallas, Texas, Oct. 1-4, 2000, pp. 1-13.
Mullins, et al., "Real-Time Determination of OBM Filtrate Contamination During Openhole Wireline Sampling", E & P Exchange, Feb. 2001, pp. 24-26.
Skibin, et al., "Self-Similarity in Contamination Transport to a Formation Fluid Tester During Cleanup Production", Transport in Porous Med., vol. 83 (1), 2009, pp. 55-72.
Smits, A. R., "In-Situ Optical Fluid Analysis as an Aid to Wireline Formation Sampling", SPE Formation Evaluation, vol. 10 (2), Jun. 1995, pp. 91-98.

MODULAR PUMPOUTS AND FLOWLINE ARCHITECTURE

RELATED APPLICATIONS

This application claims the benefit of the filing date of U.S. Provisional Application No. 61/426,573, filed on Dec. 23, 2010, the disclosure of which is incorporated by reference in its entirety. This application is also a continuation-in-part of U.S. patent application Ser. No. 12/690,231, filed on Jan. 20, 2010, which is a continuation-in-part of application Ser. No. 11/609,384, filed on Dec. 12, 2006, which is a continuation-in-part of application Ser. No. 11/219,244, filed on Sep. 2, 2005, now U.S. Pat. No. 7,484,563, which is a continuation-in-part of application Ser. No. 10/711,187, filed on Aug. 31, 2004, now U.S. Pat. No. 7,178,591, which is a continuation-in-part of application Ser. No. 11/076,567, filed on Mar. 9, 2005, now U.S. Pat. No. 7,090,012, which is a division of application Ser. No. 10/184,833, filed on Jun. 28, 2002, now U.S. Pat. No. 6,964,301, all of which are incorporated by reference herein in their entireties. This application is also a continuation-in-part of U.S. patent application Ser. No. 12/478,819, filed on Jun. 5, 2009, the disclosure of which is incorporated by reference herein in its entirety.

BACKGROUND OF THE DISCLOSURE

Sampling hydrocarbon fluids from subterranean formations involves positioning a formation sampling tool in a borehole adjacent a formation, sealing an interval of the borehole along the tool and adjacent the formation and extracting sample fluid from the formation. The sample fluid may then be evaluated (e.g., downhole and/or at the surface of the Earth) to facilitate drilling and/or hydrocarbon production operations. Some formation sampling tools include a single flowline architecture and pumpout sections above and below a probe module via which formation fluid is extracted from a formation. Some other formation sampling tools may provide a dual flowline architecture to enable focused sampling with a probe having a sample inlet and a guard inlet. However, these dual flowline sampling tools often use pumpout modules dedicated to either a sample flowline or a guard flowline.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
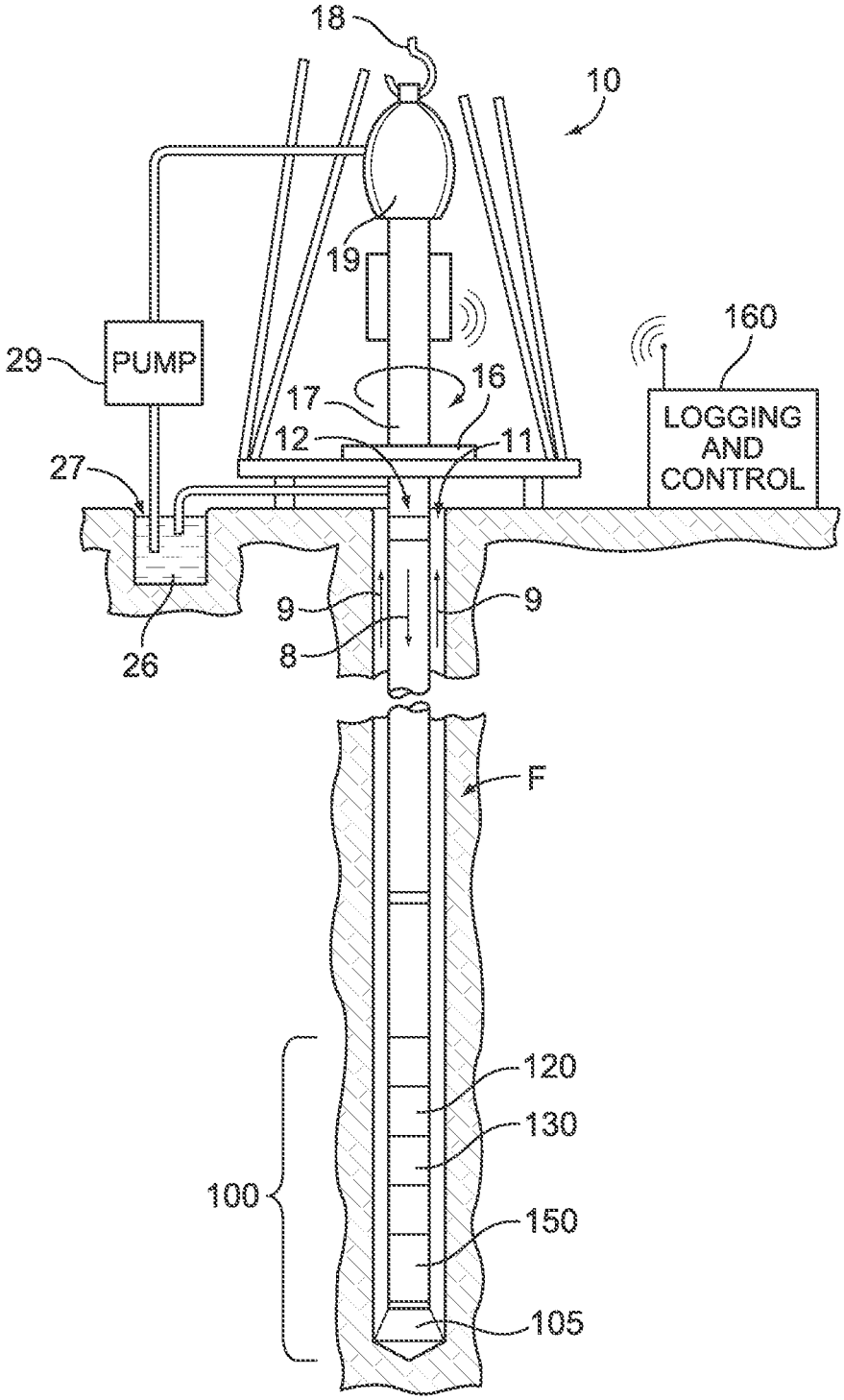
FIG. 1 is a wellsite system according to one or more aspects of the present disclosure.

It is to be understood that the following disclosure provides many different embodiments or examples for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features such that the first and second features may not be in direct contact.

One or more aspects of the present disclosure relate to modular pumpouts and flowline architecture. More specifically, the example apparatus and methods described herein may be used, for example, to provide a highly modular and operationally flexible formation sampling tool and/or formation tester. In particular, the examples described herein may generally include a formation sampling tool or tester having a dual flowline architecture in which multiple pumpouts or pump modules are interconnected via valves (e.g., valve assemblies) and/or fluid routing modules to enable various formation cleanup and/or focused sampling operations to be performed by a single formation tester.

The cleanup operations that may be performed using the examples described herein include a co-mingled flow cleanup using any one of multiple pumpouts or pump modules. Thus, in the event that one or more pump modules are inoperative, the examples described herein enable fluid routing or re-routing to permit any remaining operative pump module(s) to perform the cleanup operation. The flowline architecture of the examples described herein also enables multiple pump modules to be fluidly coupled in a bus-like manner to enable the pumping capacities of the pump modules to be added. Thus, in the case multiple pumps are operated simultaneously in this manner to perform, for example, a co-mingled flow cleanup operation, the cleanup operation can proceed more rapidly due to the combined capacity of (i.e., the volume of fluid pumped or extracted by) the multiple pump modules. The examples described herein also enable cleanup operations to be performed using multiple pump modules in a split flow configuration.

The sampling operations that may be performed using the examples described herein include a split flow focused sampling operation using multiple pump modules and/or a co-mingled flow focused sampling operation using any one of multiple pump modules. The examples described herein may be used to acquire the fluid samples in a low shock mode and/or a reverse low shock mode. Further, the flowline architecture and flexible fluid routing or re-routing capabilities of the examples described herein enable mitigation of a failed pump module in a sampling operation such that an operative pump module can perform the sampling operation.

The dual flowline architecture of the examples described herein also provides a second flowline in each of the pump modules where the second flowline is isolated from a pump within the pump module, a valve or valves coupled to the first pump and, more generally, the first flowline. Such isolation of the second flowline from the first flowline and, particularly, the pump, enables routing of fluid through the second flowline of the pump module in response to, for example, a failure of the pump without the possibility of any stagnant fluid in the failed or inoperative pump contaminating the fluid flowing through the second flowline.

In the examples described herein, the pumpouts or pump modules are located on one side (e.g., uphole) of a focused sampling probe module. However, other locations of the pump modules (e.g., downhole relative to a sampling probe module) can be employed without departing from the scope of this disclosure. Additionally, the modular pumpouts or pump modules described herein are mechanically interchangeable and are not uniquely associated with sample or guard flowlines. Further, while the example modular pumpouts or pump modules described herein are mechanically interchangeable, the pump modules may have the same or different specifications or characteristics such as pumping capacities or rates, pressure ratings, etc. Thus, a downhole tool including a plurality of these modular pump modules having different specifications may be operated to selectively operate these pump modules to adapt to different sampling environments that may be encountered within a given borehole (e.g., during a given run) and/or among multiple boreholes. Still further, while the examples described herein depict pump modules in which the pumps contained therein have outlets coupled to fluid exit ports on the pump module. However, such exit ports could be located on any other portion of a downhole tool without departing from the scope of this disclosure.

As used herein, the terms "valve" and "valve assembly" refer to one or more components or devices that may be used to control or change the flow of a substance or fluid. Thus, in some cases a valve or valve assembly may be implemented using a single valve body or housing, while in other cases, a valve assembly may be implemented using multiple valve bodies or housings that have been fluidly coupled as needed to perform the desired valve function. More specifically, for example, a valve or valve assembly having three ports could be implemented using a single valve body providing three fluid connections. However, without departing from the scope of this disclosure, such a valve or valve assembly could instead be implemented using multiple valve bodies and/or other devices that are fluidly coupled to perform the same function of the aforementioned three-port valve.

FIG. 1 depicts a wellsite system including downhole tool(s) according to one or more aspects of the present disclosure. The wellsite drilling system of FIG. 1 can be employed onshore and/or offshore. In the example wellsite system of FIG. 1, a borehole 11 is formed in one or more subsurface formations by rotary and/or directional drilling.

As illustrated in FIG. 1, a drill string 12 is suspended in the borehole 11 and includes a bottom hole assembly (BHA) 100 having a drill bit 105 at its lower end. The BHA 100 may incorporate a formation tester or sampling tool embodying aspects of the example modular pumpouts and/or flowline architecture described herein. A surface system includes a platform and derrick assembly 10 positioned over the borehole 11. The derrick assembly 10 includes a rotary table 16, a kelly 17, a hook 18 and a rotary swivel 19. The drill string 12 is rotated by the rotary table 16, energized by means not shown, which engages the kelly 17 at an upper end of the drill string 12. The example drill string 12 is suspended from the hook 18, which is attached to a traveling block (not shown), and through the kelly 17 and the rotary swivel 19, which permits rotation of the drill string 12 relative to the hook 18. A top drive system may also be used.

In the example depicted in FIG. 1, the surface system further includes drilling fluid 26, which is commonly referred to in the industry as mud, and which is stored in a pit 27 formed at the well site. A pump 29 delivers the drilling fluid 26 to the interior of the drill string 12 via a port in the rotary swivel 19, causing the drilling fluid 26 to flow downwardly through the drill string 12 as indicated by the directional arrow 8. The drilling fluid 26 exits the drill string 12 via ports in the drill bit 105, and then circulates upwardly through the annulus region between the outside of the drill string 12 and the wall of the borehole 11, as indicated by the directional arrows 9. The drilling fluid 26 lubricates the drill bit 105, carries formation cuttings up to the surface as it is returned to the pit 27 for recirculation, and creates a mudcake layer (not shown) on the walls of the borehole 11.

The example bottom hole assembly 100 of FIG. 1 includes, among other things, any number and/or type(s) of logging-while-drilling (LWD) modules or tools (one of which is designated by reference numeral 120) and/or measuring-while-drilling (MWD) modules (one of which is designated by reference numeral 130), a rotary-steerable system or mud motor 150 and the example drill bit 105. The MWD module 130 measures the azimuth and inclination of the BHA 100 to enable monitoring of the borehole trajectory.

The example LWD tool 120 and/or the example MWD module 130 of FIG. 1 may be housed in a special type of drill collar, as it is known in the art, and contains any number of logging tools and/or fluid sampling devices. The example LWD tool 120 includes capabilities for measuring, processing and/or storing information, as well as for communicating with the MWD module 130 and/or directly with the surface equipment, such as, for example, a logging and control computer 160.

The logging and control computer 160 may include a user interface that enables parameters to be input and or outputs to be displayed that may be associated with the drilling operation and/or a formation F traversed by the borehole 11. While the logging and control computer 160 is depicted uphole and adjacent the wellsite system, a portion or all of the logging and control computer 160 may be positioned in the bottom hole assembly 100 and/or in a remote location.

Figure 2:
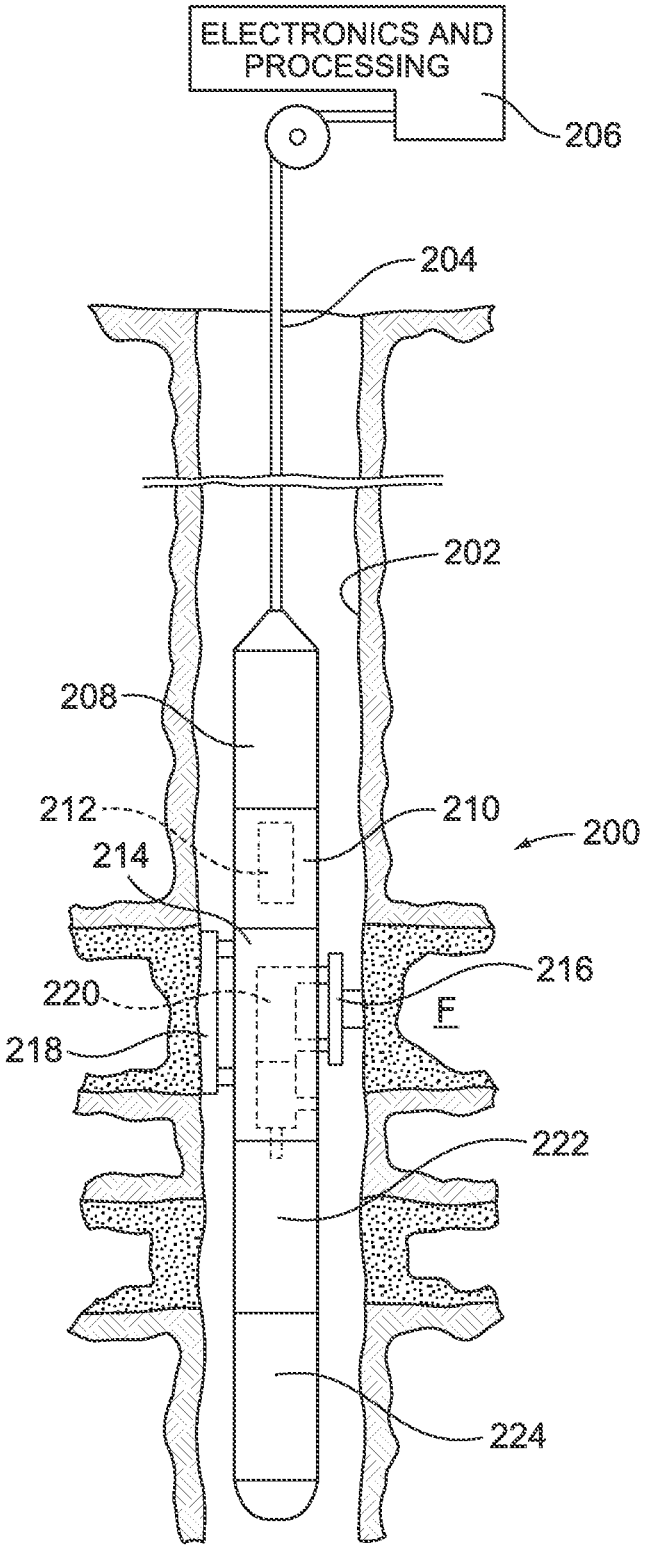
FIG. 2 is a wireline system according to one or more aspects of the present disclosure.

FIG. 2 depicts an example wireline system including downhole tool(s) according to one or more aspects of the present disclosure. The example wireline tool 200 may extract and analyze formation fluid samples and is suspended in a borehole or wellbore 202 from the lower end of a multi-conductor cable 204 that is spooled on a winch (not shown) at the surface. At the surface, the cable 204 is communicatively coupled to an electrical control and data acquisition system 206. The tool 200 has an elongated body 208 that includes a collar 210 having a tool control system 212 to control extraction of formation fluid from a formation F and measurements performed on the extracted fluid.

The wireline tool 200 also includes a formation tester 214, which may be constructed to embody one or more aspects of the example modular pumpouts or pump modules and/or flowline architecture described herein. The formation tester 214 may include a selectively extendable fluid admitting assembly 216 and a selectively extendable tool anchoring member 218 that are respectively arranged on opposite sides of the body 208. The fluid admitting assembly 216 is to selectively seal off or isolate selected portions of the wall of the wellbore 202 to fluidly couple to the adjacent formation F and draw fluid samples from the formation F. The formation tester 214 also includes a fluid analysis module 220 through which the obtained fluid samples flow. The fluid may thereafter be expelled through a port (not shown) or it may be sent to one or more fluid collecting chambers 222 and 224, which may receive and retain the formation fluid for subsequent testing at the surface or a testing facility.

In the illustrated example, the electrical control and data acquisition system 206 and/or the downhole control system 212 are to control the fluid admitting assembly 216 to draw fluid samples from the formation F and to control the fluid analysis module 220 to measure the fluid samples. In some example implementations, the fluid analysis module 220 may analyze the measurement data of the fluid samples as described herein. In other example implementations, the fluid analysis module 220 may generate and store the measurement data and subsequently communicate the measurement data to the surface for analysis at the surface. Although the downhole control system 212 is shown as being implemented separate from the formation tester 214, in some example implementations, the downhole control system 212 may be implemented in the formation tester 214. Additionally, the formation tester 214 may include one or more pumpouts or pump modules (not shown) to facilitate the collection of fluid samples.

One or more modules or tools of the example drill string 12 shown in FIG. 1 and/or the example wireline tool 200 of FIG. 2 may employ the example apparatus described herein. While the example apparatus described herein are described in the context of drill strings and/or wireline tools, they are also applicable to any number and/or type(s) of additional and/or alternative downhole tools such as coiled tubing deployed tools.

Figure 3:
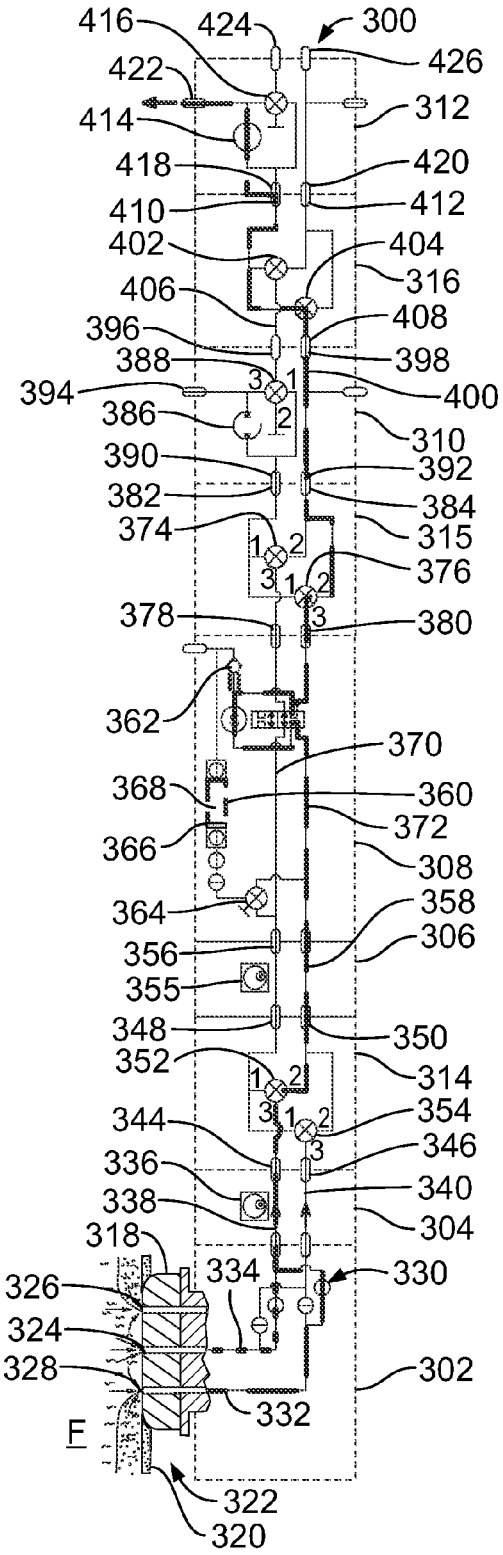
FIGS. 3-12 are schematic views of apparatus according to one or more aspects of the present disclosure.

FIG. 3 is a schematic diagram of an example portion of a formation sampling tool or tester 300 that may be used to implement the examples described herein. The formation tester 300 includes a focused probe module 302, lower and upper fluid analysis modules 304 and 306, a sample carrier module 308, lower and upper pumpouts or pump modules 310 and 312, and lower, middle and upper fluid routing modules 314, 315 and 316.

The focused probe module 302 includes a packer 318 to engage a wall 320 of a wellbore or borehole 322. The packer 318 has a sample inlet 324 and guard inlets 326 and 328 into which fluid from a formation F may be drawn as indicated by the arrows. The focused probe module 302 also includes a plurality of valve assemblies or valves 330 coupled to a guard flowline 332 (which is coupled to the guard inlets 326 and 328) and an evaluation or sample flowline 334 (which is coupled to the sample inlet 324).

The lower fluid analysis module 304 is mechanically and fluidly coupled to the focused probe module 302. The lower fluid analysis module 304 includes a fluid analyzer (e.g., an optical fluid analyzer) 336 to, for example, facilitate a determination of whether a cleanup operation in connection with the formation F is sufficiently complete. As shown in FIG. 3, the lower fluid analysis module 304 includes two flowlines 338 and 340, one of which passes adjacent the fluid analyzer 336 to enable fluid analysis of the fluid flowing in that flowline. The other flowline 340 passes through the fluid analysis module 304 without being monitored by the fluid analyzer 336. As described in greater detail below, the valves 330 of the probe module 302 may be operated to enable fluid in the guard flowline 332 and/or the fluid in the sample flowline 334 to pass through the flowline 338 to selectively enable a fluid analysis thereof by the fluid analyzer 336. In other words, the flow of the fluid in the guard and sample flowlines 332 and 334 may be split so that fluid from only one of the flowlines 332 and 334 is analyzed by the fluid analyzer 336 or the fluid may be co-mingled and then analyzed by the fluid analyzer 336. In the case where the fluid flow is split, the fluid that is not to be analyzed by the fluid analyzer 336 is directed by the valves 330 to flow through the rightmost flowline 340 depicted in FIG. 3. Also, if desired, the valves 330 may be operated to cause the fluid flowing in the flowlines 332 and 334 to flow through the rightmost flowline 340, thereby effectively bypassing the fluid analyzer 336.

The lower fluid routing module 314 includes first and second inlets 344 and 346, first and second outlets 348 and 350, and first and second valves 352 and 354. Each of the first and second valves 352 and 354 has respective first, second and third ports, which are numbered "1," "2" and "3," respectively, for reference in FIG. 3. However, it should be understood the numbers "1," "2" and "3" are merely used to distinguish between the different ports and any other reference numbers or letters could be used to instead refer to these ports. As shown, the first ports are fluidly coupled to the first outlet 348 and the second ports are fluidly coupled to the second outlet 350. The third port of the first valve 352 is fluidly coupled to the first inlet 344 and the third port of the second valve 354 is fluidly coupled to the second inlet 346. The valves 352 and 354 may be operated to cause fluid received by the inlets 344 and 346 to flow through the fluid routing module 314 via separate (i.e., split) flow paths to respective ones of the outlets 348 and 350 or to be mixed or merged (i.e., co-mingled) within the fluid routing module 314 to flow from the inlets 344 and 346 to only one of the outlets 348 and 350. In this manner, fluid received by the lower fluid routing module 314 may be routed as desired to the upper fluid analysis module 306.

The upper fluid analysis module 306 is similar or identical to the lower fluid analysis module 304 and, thus, also includes a fluid analyzer 355, which may be different than or identical to the fluid analyzer 336. As noted above, the valves 352 and 354 may be operated to cause fluid to be routed adjacent the fluid analyzer 355 of the upper fluid analysis module 306 via a leftmost flowline 356 and/or may be routed via a rightmost flowline 358 which does not subject any fluid therein to a fluid analysis by the fluid analyzer 355.

The sample carrier module 308 includes a sample chamber 360, a relief valve 362 and a sampling valve 364. A piston 366 of the sample bottle or chamber 360 may initially be in the position shown in FIG. 3 and a space or volume 368 of the sample chamber 360 above the piston 366 may be filled with a pressurized fluid (e.g., water, drilling fluid, etc.) to facilitate low shock sampling operations. The sampling valve 364 may be operated to route fluid from either of two flowlines 370 and 372 passing through the sample carrier module 308. Further, the relief valve 362 enables the pressurized fluid initially stored in the space or volume 368 to be purged via the flowline 372 during a sample acquisition operation.

The middle fluid routing module 315 is identical to the lower fluid routing module 314 and, thus, includes first and second valves 374 and 376 that are fluidly coupled to first and second inlets 378 and 380 and first and second outlets 382 and 384 as described above in connection with the lower fluid routing module 314.

The lower pumpout or pump module 310 includes a pump 386, a valve 388, first and second inlets 390 and 392, and first, second and third outlets 394, 396 and 398. The pump 386, the valve 388, the first inlet 390 and the second outlet 396 form at least part of or are fluidly coupled to a first flowline, and the second inlet 392 is fluidly coupled to the third outlet via a second flowline 400, which is fluidly isolated from the first flowline. An inlet of the pump 386 is fluidly coupled to the first inlet 390, and an outlet of the pump 386 is fluidly coupled to the first outlet 394. While the first outlet 394 is depicted as being located on the pump module 310, this outlet 394 could be located in any other location on the tester or tool 300. The valve 388 has first, second and third ports, which have been labeled as "1," "2" and "3," respectively for reference. As shown, the first port is fluidly coupled to the first inlet 390, the second port is fluidly coupled to the first outlet 394 and the pump outlet, and the third port is fluidly coupled to the second outlet 396. Also, as shown, the first and second outlets 382 and 384 of the middle fluid routing module 308 are fluidly coupled to the first and second inlets 390 and 392, respectively, of the lower pump module 310.

The upper fluid routing module 316 interposes the upper and lower pump modules 312 and 310 and is identical to the middle and lower fluid routing modules 315 and 314 and, thus, includes first and second valves 402 and 404 fluidly coupled to first and second inlets 406 and 408 and first and second outlets 410 and 412 as described in connection with the lower fluid routing module 314 above. Further, the upper pump module 312 is similar or identical to the lower pump module 310 and, thus, includes a pump 414, a valve 416, first and second inlets 418 and 420, and first, second and third outlets 422, 424 and 426. As shown, the first and second inlets 418 and 420 of the upper pump module 312 are fluidly coupled to the first and second outlets 410 and 412, respectively, of the upper fluid routing module 316.

The pumps 414 and 386 of the upper and lower pump modules 312 and 310, respectively, may have identical characteristics or different characteristics to suit the needs of particular applications. For example, the pumps 414 and 386 may have identical or different pumping rates, pressure ratings, etc. Thus, during operations of the formation tester 300, the fluid routing modules 314, 315 and 316 and the pumps 414 and 386 may be selectively operated in accordance with the characteristics of the pumps 414 and 386 based on the operating environment to which the formation tester 300 is exposed and/or the operation to be performed by the formation tester 300.

The number and arrangement of fluid routing modules and pump modules shown in FIG. 3 is merely one example implementation of the teachings of this disclosure. Thus, any other number and/or arrangement of the fluid routing modules and/or pump modules may be used instead without departing from the scope of this disclosure. Also, one or more of the modules shown in FIG. 3 may be eliminated and/or different modules may be added to suit the needs of a particular application.

Figure 6:
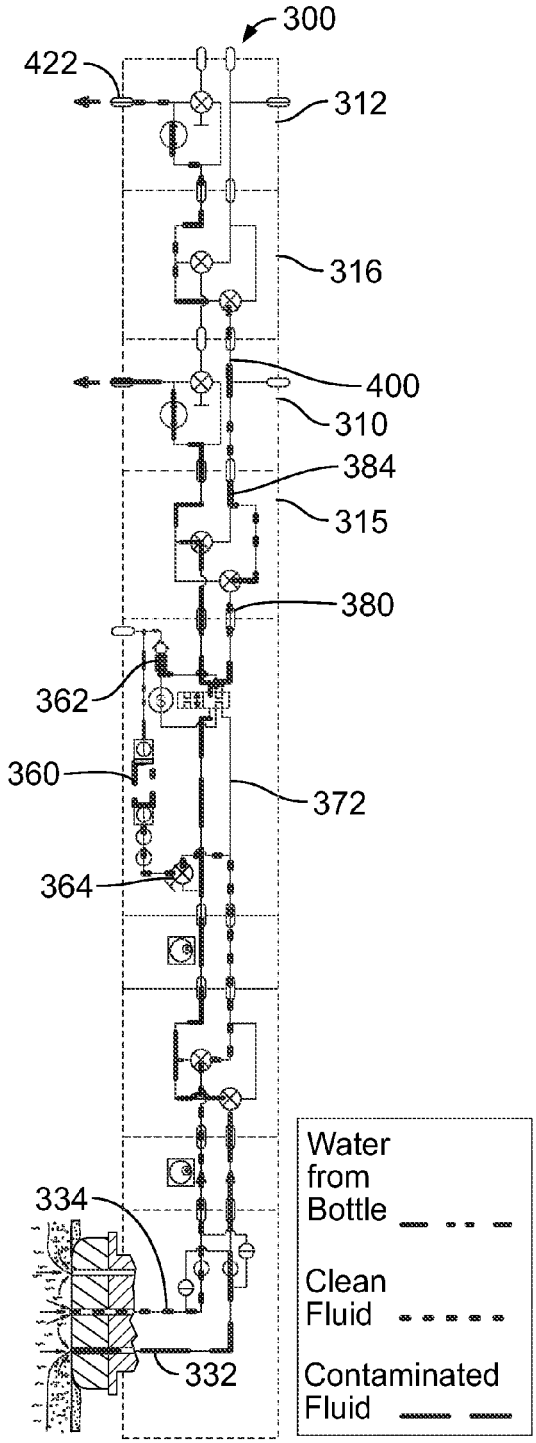
Figure 8:
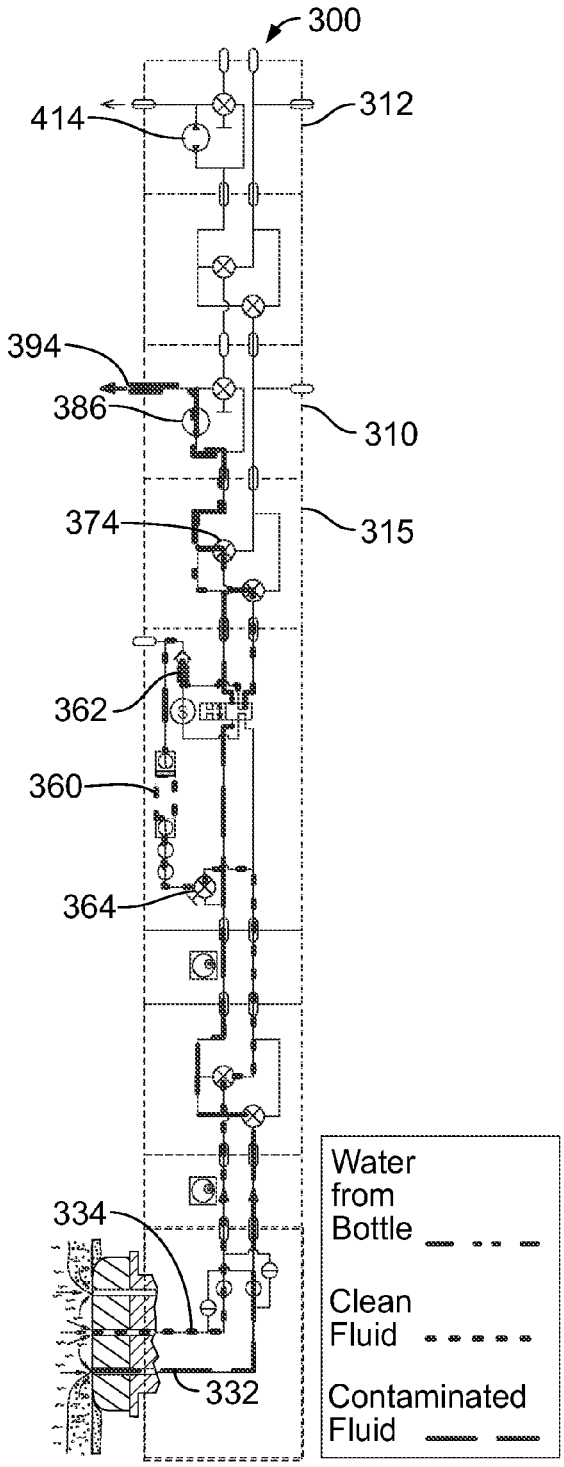
Figure 10:
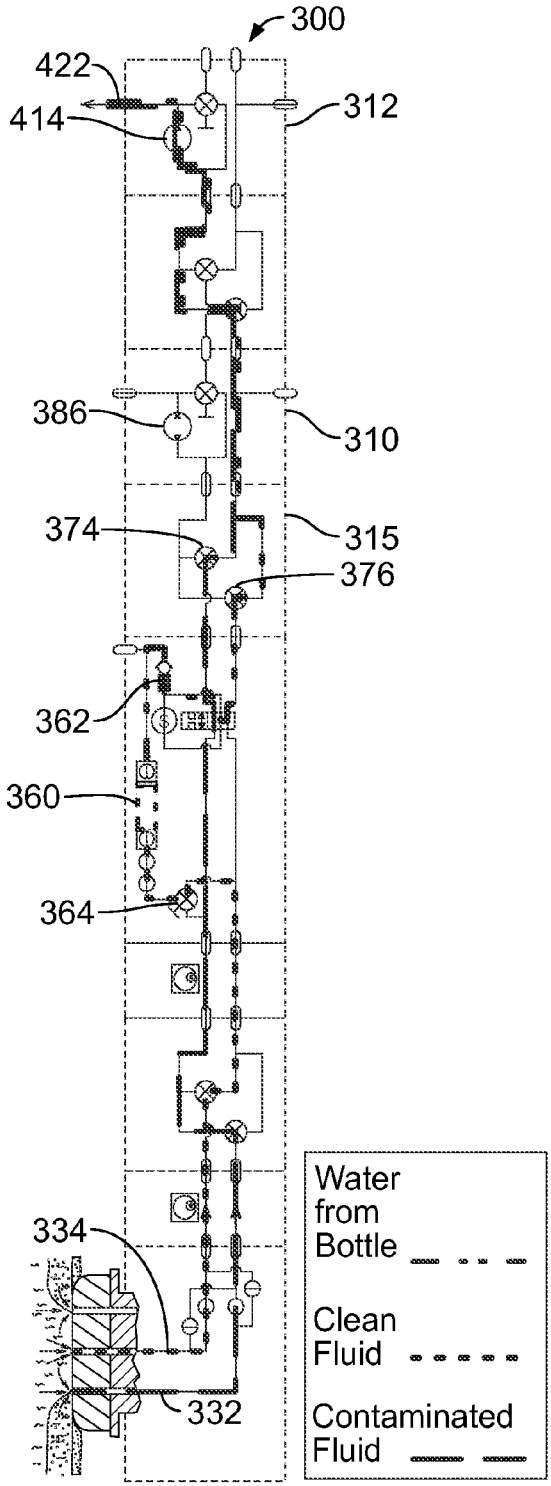

In the example of FIG. 3, the various valve assemblies or valves of the formation tester 300 are operated to perform a co-mingled flow cleanup operation using the upper pump module 312. More specifically, as represented by the dashed lines in FIG. 3, fluid is extracted from the formation F via the flowlines 332 and 334, is merged or within the probe module 302 and flows through the fluid analysis module 304 via the leftmost flowline 338 adjacent the fluid analyzer 336, which may be used to monitor the amount of contamination in the fluid exacted from the formation F. The co-mingled fluid enters the first inlet 344 of the lower fluid routing module 314, passes through the third port of the first valve 352 and out the second port of the first valve 352 to the second outlet 350 of the lower fluid routing module 314. The fluid then flows through the rightmost flowline 372 of the sample carrier module 308 to the second inlet 380 of the middle fluid routing module 315. The fluid continues through the second valve 376 and out the second outlet 384 of the middle fluid routing module 315 to the second inlet 392 of the lower pump module 310. The fluid then passes through the lower pump module 310 via the flowline 400 and the third outlet 398 to the second inlet 408 of the upper fluid routing module 316. From the second inlet 408, the fluid flows through the second valve 404 to the first outlet 410 of the upper fluid routing module 316 and into the first inlet 418 of the upper pump module 312. The fluid is then drawn from the first inlet 418 of the upper pump module 312 into the inlet of the pump 414 and is passed from the outlet of the pump 414 to the first outlet 422 of the upper pump module 312. The fluid flowing out of the first outlet 422 of the upper pump module 312 is a co-mingled (i.e., mixture) flow of clean fluid and contaminated fluid. The cleanup operation depicted in FIG. 3 may be continued until the level of contamination on the fluid as measured by the fluid analyzer 336 is sufficiently low to begin a sample acquisition operation (e.g., as depicted in FIGS. 6, 8 and 10).

Various additional operational modes of the example formation tester 300 are depicted in FIGS. 4-11. Some of the reference numbers associated with the structures making up the formation tester 300 have not been included in FIGS. 4-11 for purposes of clarity. However, dashed lines representing fluid flow(s) through the formation tester 300 for the operational mode represented in each of FIGS. 4-11 have been provided.

Figure 4:
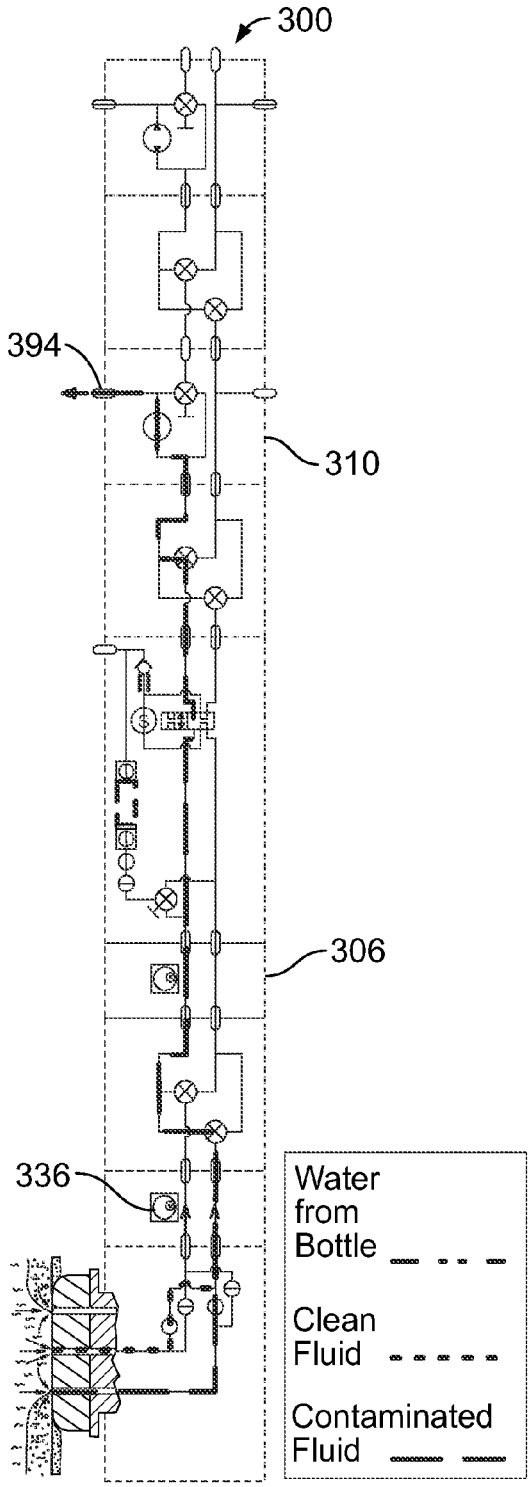

FIG. 4 depicts an example co-mingled flow cleanup operation using the lower pump module 310. In this example, the lower fluid analyzer 336 is bypassed and fluid analysis is instead performed using the upper fluid analysis module 306. Both clean and contaminated fluid are expelled via the first outlet 394 of the lower pump module 310.

Figure 5:
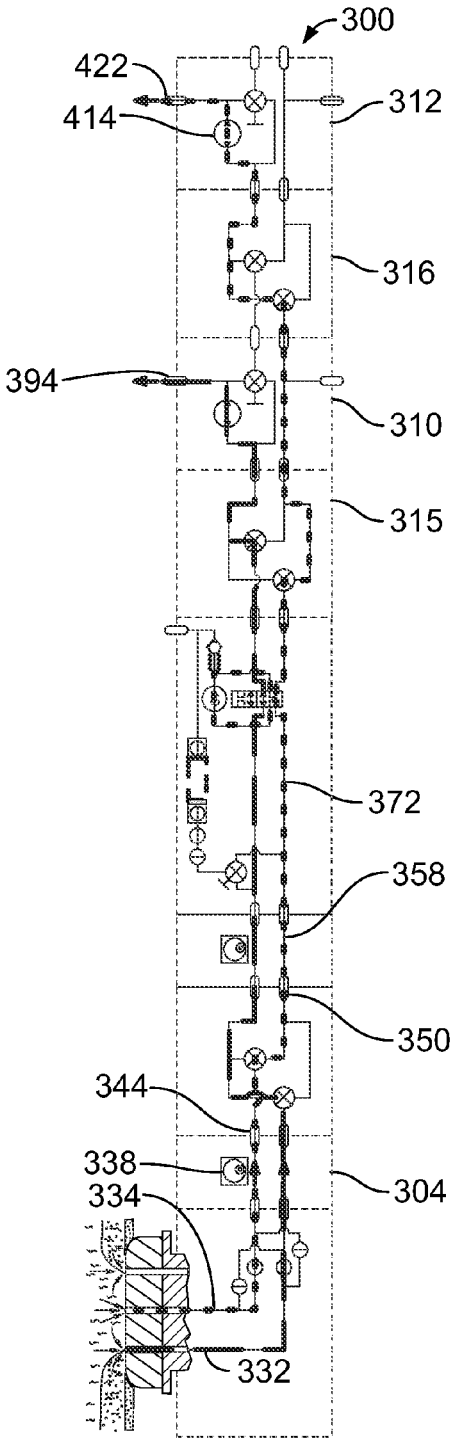

FIG. 5 depicts an example split flow cleanup operation that uses the upper and lower pump modules 312 and 310. In this example, fluid drawn via the sample flowline 334 follows a separate path through the tool 300 than the fluid drawn via the guard flowline 332. More specifically, clean fluid drawn via the sample flowline 334 flows through the leftmost flowline 338 of the lower fluid analysis module 304, in the inlet 344 and out the outlet 350, through the flowlines 358 and 372 and then through the middle fluid routing module 315, the lower pump module 310, the upper fluid routing module 316, through the pump 414 of the upper pump module 312 and out the first outlet 412 of the upper pump module 312 as shown. The contaminated fluid drawn via the guard flowline 332 follows a separate path as shown and exits the first output 394 of the lower pump module 310. The cleanup operation shown in FIG. 5 may continue until the lower fluid analysis module 304 determines that the fluid drawn via the sample fluid line 334 through the leftmost flowline 338 is sufficiently clean.

FIG. 6 depicts an example split flow sample acquisition operation using the upper and lower pump modules 312 and 310. The flow path followed by the fluid drawn via the guard flowline 332 by the lower pump module 310 is the same as shown in FIG. 5. However, the fluid drawn via the sample flowline by the upper pump module 312 is diverted from the flowline 372 by the valve 364 into the sample bottle or chamber 360. Further, the pressurized fluid (e.g., water) stored in the volume 368 above the piston 366 (as shown in FIG. 3) flows out of the sample bottle or chamber 360 via the relief valve 362 and into the second inlet 380 of the middle fluid routing module 315. The pressurized fluid from the sample chamber 360 then flows out the second outlet 384 of the middle fluid routing module 315, through the flowline 400 of the lower pump module 310, through the upper fluid routing module 316 and is then expelled via the first outlet 412 of the upper pump module 312.

Figure 7:
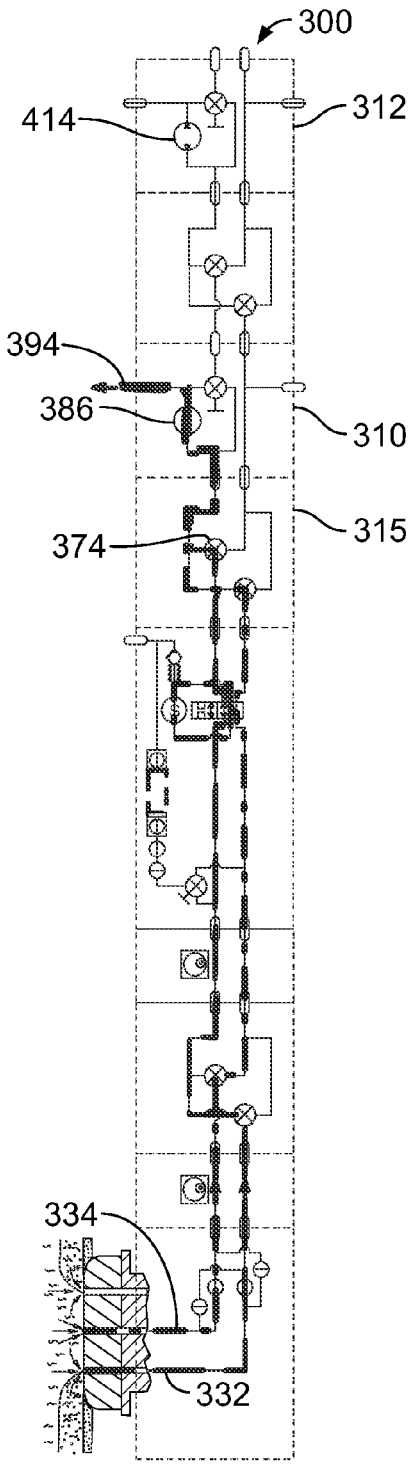

FIGS. 7 and 8 depict example operations that may be performed when the pump 414 of the upper pump module 312 has failed or is otherwise inoperative. More specifically, FIG. 7 depicts a co-mingled flow cleanup operation and FIG. 8 depicts a sample acquisition operation. In FIG. 7, the fluid drawn via the sample flowline 334 and the guard flowline 332 flows through separate paths up to the first port of the first valve 374 of the middle fluid routing module 315, at which point the fluid from the sample flowline 334 merges with the fluid from guard flowline 332. The merged fluid is then expelled via the first outlet 394 of the lower pump module 310 by the pump 386. In FIG. 8, the valve 364 diverts fluid drawn via the sample flowline 334 into the sample chamber 360 and the pressurized fluid stored in the volume 368 of the chamber 360 (as shown in FIG. 3) flows out of the volume 368 of the chamber 360, through the relief valve 362 and then merges with the contaminated fluid drawn via the guard flowline 332 at the first port of the first valve 374 of the middle fluid routing module 315. The merged fluid (i.e., the pressurized fluid (e.g., water) and contaminated formation fluid) is then expelled via the first outlet 394 of the lower pump module 310 by the pump 386.

Figure 9:
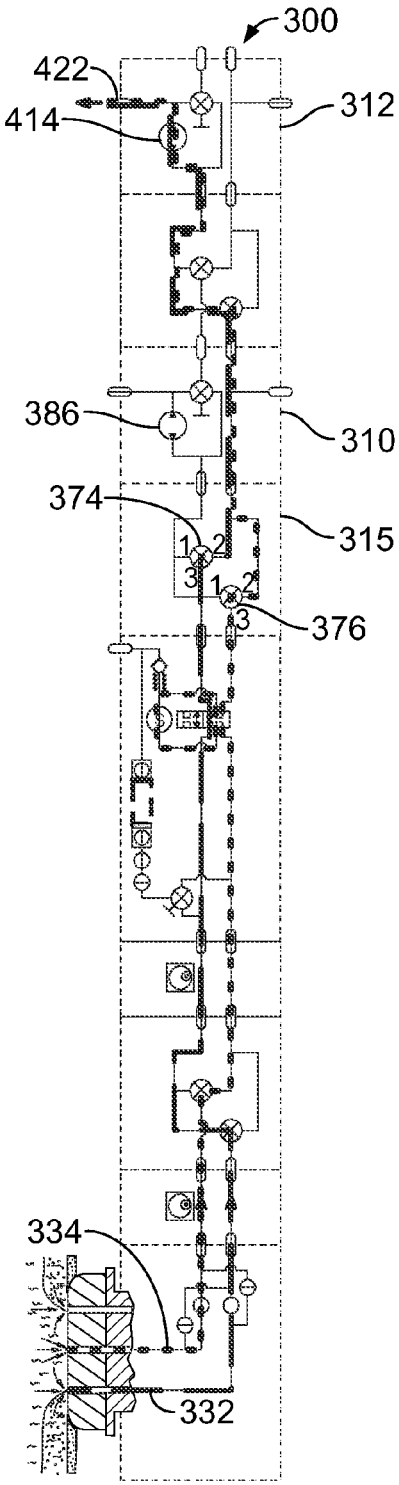

FIGS. 9 and 10 depict example operations that may be performed when the pump 386 of the lower pump module 310 has failed or is otherwise inoperative. More specifically, FIG. 9 depicts a co-mingled flow cleanup operation and FIG. 10 depicts a sample acquisition operation. In FIG. 9, the fluid drawn via the sample flowline 334 and the guard flowline 332 flows through separate paths up to the second ports of the first and second valves 374 and 376 of the middle fluid routing module 315, at which point the fluid from the sample flowline 334 merges with the fluid from the guard flowline 332. The merged fluid is then expelled via the first outlet 422 of the upper pump module 312 by the pump 414. In FIG. 10, the valve 364 diverts fluid drawn via the sample flowline 334 into the sample chamber 360 and the pressurized fluid stored in the volume 368 of the chamber 360 (as shown in FIG. 3) flows out of the volume 368 of the chamber 360 through the relief valve 362 and then merges with the contaminated fluid drawn via the guard flowline 332 at the second ports of the first and second valves 374 of the middle fluid routing module 315. The merged fluid (i.e., the pressurized fluid (e.g., water) and contaminated formation fluid) is then expelled via the first outlet 422 of the upper pump module 312 by the pump 414.

Figure 11:
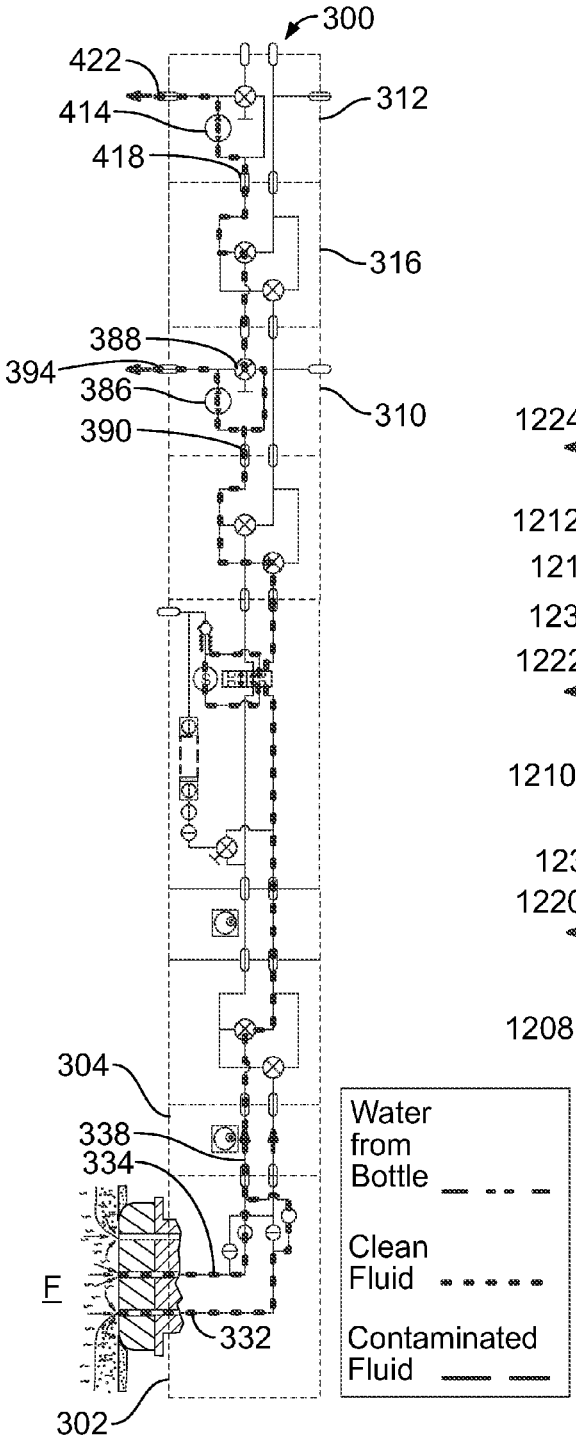

FIG. 11 depicts an example operation that may be performed with two pumps working in parallel. In particular, FIG. 11 depicts a co-mingled flow cleanup operation in which the upper and lower pump modules 312 and 310 are operated simultaneously. As shown in FIG. 11, fluid is drawn into the guard and sample flowlines 332 and 334 and then merges in the leftmost flowline 338 of the lower fluid analysis module 304. The merged fluid then follows the path shown in FIG. 11 to reach the first inlet 390 of the lower pump module 310. A portion of the merged fluid is drawn through the pump 386 and is expelled via the first outlet 394 of the lower pump module 310. Another portion of the merged fluid travels via the valve 388 through the upper fluid routing module 316 and into the first inlet 418 of the upper pump module 312. This other portion of the merged fluid is then expelled at the first outlet 412 via the pump 414. Thus, in the example operation of FIG. 11, the rate at which a volume of fluid is extracted from the formation F via the probe module 302 can be increased significantly (e.g., doubled) versus operations that use only one of the pump modules 310 and 312. As a result, the time required to perform a cleanup operation can be reduced significantly.

Figure 12:
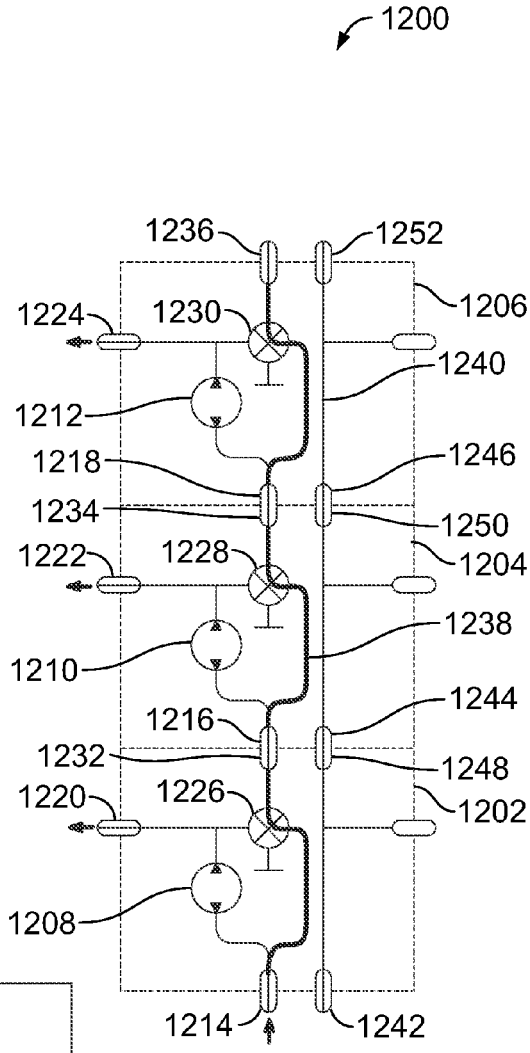

FIG. 12 depicts an example manner in which a plurality of pump modules may be coupled to form a bus-like dual flowline architecture 1200. In the example of FIG. 12, first second and third pump modules 1202, 1204 and 1206 are physically serially coupled together and functionally parallel (i.e., fluidly connected in parallel). However, other modules (e.g., fluid routing modules and/or other modules) may be interposed among the pump modules 1202, 1204 and 1206 as needed to suit the needs of a particular application. In the example of FIG. 12, the pump modules 1202, 1204 and 1206 include respective pumps 1208, 1210 and 1212 fluidly coupled between respective first inlets 1214, 1216 and 1218 and first outlets 1220, 1222 and 1224. The pump modules 1202, 1204 and 1206 also include respective valves 1226, 1228 and 1230 that are fluidly coupled between the respective first inlets 1214, 1216 and 1218 and second outlets 1232, 1234 and 1236. The second outlet 1232 of the first pump module 1202 is fluidly coupled to the first inlet 1216 of the second pump module 1204, and the second outlet 1234 of the second pump module 1204 is fluidly coupled to the first inlet 1218 of the third pump module 1206. The manner in which the pumps 1208, 1210 and 1212 are coupled to the inlets 1214, 1216 and 1218 and the outlets 1232, 1234 and 1236 enables any one of the pumps or combination of the pumps 1208, 1210 and 1212 to be operated at a given time. As a result, if any one or more of the pumps 1208, 1210 and 1212 has failed or otherwise become inoperative, any remaining one(s) of the pumps 1208, 1210 and 1212 can be operated to draw fluid. In the case that one of more of the pumps 1208, 1210 and 1212 has become inoperative, fluid can continue to flow through the respective pump module(s) 1202, 1204 and 1206 via the respective valve(s) 1226, 1228 and 1230. As can be seen in FIG. 12, the fluid flow path from the first inlets 1214, 1216 and 1218, through the valves 1226, 1228 and 1230 and the second outlets 1226, 1228 and 1230 forms a fluid bus 1238 from which the pumps 1208, 1210 and 1212 can independently draw fluid, thereby enabling any one or combination of the pumps 1208, 1210 and 1212 to be operated to draw fluid from the fluid bus 1238. This allows the capacities of the pumps to be additive to cover a wide range of pumping rates for different applications. Additionally, this provides pump redundancy to enable mitigation of pump failure(s), thereby increasing the overall reliability of a tool employing the pump module architecture 1200 of FIG. 12. Still further, the pumps 1208, 1210 and 1212 may have different specifications to provide additional operational flexibility. A second flowline 1240 is formed through the pump modules 1202, 1204 and 1206 via fluidly connected second inlets 1242, 1244 and 1246 and third fluid outlets 1248, 1250 and 1252. This second flowline 1240 enables bypassing any one or more of the pump modules 1202, 1204 and 1206 without the risk of stagnant fluid in one or more of the respective pumps 1208, 1210 and 1212 contaminating the fluid flowing in the second flowline 1240. In other words, the second flowline 1240 is fluidly isolated from the first flowline(s) associated with or formed by the pumps 1208, 1210 and 1212 and valves 1226, 1228 and 1230.

The pump module architecture 1200 shown in FIG. 12 is employed in the examples of FIG. 3-11 using only two pump modules and including interposing modules. However, the architecture 1200 of FIG. 12 may be used in any other manner and may, if desired, include more than two or three pump modules as needed to suit the needs of a particular application.

As can be appreciated, the foregoing disclosure introduces an apparatus comprising a downhole tool to sample fluid from a subterranean formation, and a plurality of fluidly coupled pump modules disposed on the downhole tool. Each pump modules may include: a pump having a pump inlet and a pump outlet, where the pump inlet is coupled to a first flowline; a first valve assembly having first, second and third ports, wherein the first port is coupled to the first flowline, the second port is coupled to the pump outlet, and the third port is coupled to the first flowline; and a second flowline not fluidly coupled to the first valve assembly or the pump. The apparatus may further include a fluid routing module fluidly coupled to at least one of the pump modules. The fluid routing module may include: second and third valve assemblies, each having respective first, second and third ports; first and second fluid inlets; and first and second fluid outlets, wherein the first ports of the second and third valve assemblies are coupled to the first fluid outlet, the second ports of the second and third valve assemblies are coupled to the second fluid outlet, the third port of the second valve assembly is coupled to the first fluid inlet and the third port of the third valve assembly is coupled to the second fluid inlet. The first fluid outlet may be coupled to the first flowline of one of the pump modules and the second fluid outlet may be coupled to the second flowline of the one of the pump modules. The first fluid inlet may be coupled to the first flowline of another one of the pump modules and the second fluid inlet may be coupled to the second flowline of the other one of the pump modules. Each of the first flowlines may fluidly couple a first inlet and first outlet of each pump module, each of the second flowlines may fluidly couple a second inlet and second outlet of each of the pump modules, and each of the pump outlets may fluidly couple to a third outlet of each of the pump modules. At least one of the pumps may have a different characteristic than another one of the pumps. The characteristic may be a pump rate or a pressure rating. Two or more of the pumps may be operated simultaneously to, for example, increase a rate at which a volume of fluid is extracted from the formation and/or to perform one or more of a cleanup operation, a sampling operation or a fluid analysis operation.

The disclosure also introduces an apparatus comprising: a pump module to be incorporated in a downhole tool. The pump module may include: a pump having a pump inlet and a pump outlet, the pump inlet to be coupled to a first flowline and the pump outlet to be coupled to an outlet to enable the pump to pump fluid into a wellbore; a valve having first, second and third ports, the first port to be coupled to the first flowline, the second port to be coupled to the outlet and the third port to be coupled to the first flowline, wherein the valve and the pump form at least part of the first flowline; and a second flowline not fluidly coupled to first flowline. The first flowline fluidly may fluidly couple a first inlet of the pump module to a second outlet of the pump module, and the second flowline may fluidly couple a second inlet of the pump module to a third outlet of the pump module. The pump module may be coupled to at least one of another pump module or a fluid routing module.

The disclosure also introduces a method involving lowering a tool into a wellbore adjacent a formation, engaging a probe of the tool to a wall of the wellbore adjacent the formation, where the probe has a first fluid inlet and a second fluid inlet. The first fluid inlet is coupled to a first flowline within the tool and the second fluid inlet is coupled to a second flowline. The method also involves operating a first pump in a first pump module of the tool, operating a second pump in a second pump module of the tool, where the second pump operates at the same time as the first pump, drawing fluid from the formation via the first and second pumps during operation of the pumps. The drawn fluid flows through the inlets of the probe into the first and second flowlines and merges into a third flowline, and wherein the fluid drawn through the third flowline by the pumps flows through the first pump module to reach the second pump module and a portion of the drawn fluid exits the first pump and another portion of the drawn fluid exits the second pump. Drawing the fluid from the formation via the first and second pumps during operation of the pumps may comprise performing a cleanup operation and may further comprise performing a fluid analysis of the drawn fluid to identify a completion of the cleanup operation. The method may further involve selectively operating at least one of the pumps to perform a sampling operation following the completion of the cleanup operation. Selectively operating at least one of the pumps to perform the sampling operation may comprise operating the first and second pumps to perform a split flow focused sampling operation or operating one of the first pump or the second pump to perform a co-mingled flow focused sampling operation. The method may further comprise routing the drawn fluid via a fluid routing module to the first pump module and/or routing the drawn fluid via a second fluid routing module to the second pump module.

Although only a few example embodiments have been described in detail above, those skilled in the art will readily appreciate that many modifications are possible in the example embodiments without materially departing from this disclosure. Accordingly, all such modifications are intended to be included within the scope of this disclosure as defined in the following claims. In the claims, means-plus-function clauses are intended to cover the structures described herein as performing the recited function and not only as structural equivalents, but also equivalent structures. Thus, although a nail and a screw may be not structural equivalents in that a nail employs a cylindrical surface to secured wooden parts together, whereas a screw employs a helical surface, in the environment of fastening wooden parts, a nail and a screw may be equivalent structures. It is the express intent of the applicant not to invoke 35 U.S.C. §112, paragraph 6 for any limitations of any of the claims herein, except for those in which the claim expressly uses the words "means for" together with an associated function.

The Abstract at the end of this disclosure is provided to comply with 37 C.F.R. §1.72(b) to allow the reader to quickly ascertain the nature of the technical disclosure. It is submitted with the understanding that it will not be used to interpret or limit the scope or meaning of the claims.

What is claimed is:

1. An apparatus, comprising:

a downhole tool to sample fluid from a subterranean formation; and a plurality of fluidly coupled pump modules disposed on the downhole tool, each pump module including:

a pump having a pump inlet and a pump outlet, where the pump inlet is coupled to a first flowline;

a first valve assembly having first, second and third ports, wherein the first port is coupled to the first flowline, the second port is coupled to the pump outlet, and the third port is coupled to the first flowline; and a second flowline not fluidly coupled to the first valve assembly or the pump;

wherein the each of the first flowlines fluidly couples a first inlet and first outlet of each pump module, each of the second flowlines fluidly couples a second inlet and second outlet of each of the pump modules, and each of the pump outlets is fluidly coupled to a third outlet of each of the pump modules.

2. The apparatus of claim 1 further comprising a fluid routing module fluidly coupled to at least one of the pump modules, the fluid routing module including:

second and third valve assemblies, each having respective first, second and third ports;

first and second fluid inlets; and first and second fluid outlets, wherein the first ports of the second and third valve assemblies are coupled to the first fluid outlet, the second ports of the second and third valve assemblies are coupled to the second fluid outlet, the third port of the second valve assembly is coupled to the first fluid inlet and the third port of the third valve assembly is coupled to the second fluid inlet.

3. The apparatus of claim 2 wherein the first fluid outlet is coupled to the first flowline of one of the pump modules and the second fluid outlet is coupled to the second flowline of the one of the pump modules.

4. The apparatus of claim 3 wherein the first fluid inlet is coupled to the first flowline of another one of the pump modules and the second fluid inlet is coupled to the second flowline of the other one of the pump modules.

5. The apparatus of claim 1 wherein at least one of the pumps has a different characteristic than another one of the pumps.

6. The apparatus of claim 5 wherein the characteristic is a pump rate or a pressure rating.

7. The apparatus of claim 1 wherein two or more of the pumps are to be operated simultaneously.

8. The apparatus of claim 7 wherein the two or more pumps are to be operated simultaneously to increase a rate at which a volume of fluid is extracted from the formation.

9. The apparatus of claim 7 wherein the two or more pumps are to be operated simultaneously to perform one or more of a cleanup operation, a sampling operation or a fluid analysis operation.

10. An apparatus, comprising:

a pump module to be incorporated in a downhole tool, the pump module comprising:

a pump having a pump inlet and a pump outlet, the pump inlet to be coupled to a first flowline and the pump outlet to be coupled to an outlet to enable the pump to pump fluid into a wellbore;

a valve having first, second and third ports, the first port to be coupled to the first flowline, the second port to be coupled to the outlet and the third port to be coupled to the first flowline, wherein the valve and the pump form at least part of the first flowline; and a second flowline not fluidly coupled to first flowline;

wherein the first flowline fluidly couples a first inlet of the pump module to a second outlet of the pump module, and wherein the second flowline fluidly couples a second inlet of the pump module to a third outlet of the pump module.

11. The apparatus of claim 10 wherein the pump module is to be coupled to at least one of another pump module or a fluid routing module.

12. A method, comprising:

lowering a tool into a wellbore adjacent a formation;

engaging a probe of the tool to a wall of the wellbore adjacent the formation, the probe having a first fluid inlet and a second fluid inlet, wherein the first fluid inlet is coupled to a first flowline within the tool and the second fluid inlet is coupled to a second flowline;

operating a first pump in a first pump module of the tool;

operating a second pump in a second pump module of the tool, the second pump operating at the same time as the first pump;

drawing fluid from the formation via the first and second pumps during operation of the pumps, wherein the drawn fluid flows through the inlets of the probe into the first and second flowlines and merges into a third flowline, and wherein the fluid drawn through the third flowline by the pumps flows through the first pump module to reach the second pump module and a portion of the drawn fluid exits the first pump and another portion of the drawn fluid exits the second pump; and routing the drawn fluid via a fluid routing module to the first pump module.

13. The method of claim 12 wherein drawing the fluid from the formation via the first and second pumps during operation of the pumps comprises performing a cleanup operation.

14. The method of claim 13 further comprising performing a fluid analysis of the drawn fluid to identify a completion of the cleanup operation.

15. The method of claim 14 further comprising selectively operating at least one of the pumps to perform a sampling operation following the completion of the cleanup operation.

16. The method of claim 15 wherein selectively operating at least one of the pumps to perform the sampling operation comprises operating the first and second pumps to perform a split flow focused sampling operation or operating one of the first pump or the second pump to perform a co-mingled flow focused sampling operation.

17. The method of claim 12 further comprising routing the drawn fluid via a second fluid routing module to the second pump module.

18. An apparatus, comprising:

a downhole tool to sample fluid from a subterranean formation; and a plurality of fluidly coupled pump modules disposed on the downhole tool, each pump module including:

a pump having a pump inlet and a pump outlet, where the pump inlet is coupled to a first flowline;

a first valve assembly having first, second and third ports, wherein the first port is coupled to the first flowline, the second port is coupled to the pump outlet, and the third port is coupled to the first flowline;

a second flowline not fluidly coupled to the first valve assembly or the pump; and a fluid routing module fluidly coupled to at least one of the pump modules, the fluid routing module including:

second and third valve assemblies, each having respective first, second and third ports;

first and second fluid inlets; and first and second fluid outlets, wherein the first ports of the second and third valve assemblies are coupled to the first fluid outlet, the second ports of the second and third valve assemblies are coupled to the second fluid outlet, the third port of the second valve assembly is coupled to the first fluid inlet and the third port of the third valve assembly is coupled to the second fluid inlet.

* * * * *